United States Patent [19]

Popper

[11] 4,140,541

[45] Feb. 20, 1979

[54] TREATMENT OF CRUDE SUGAR JUICES BY ION EXCHANGE

[76] Inventor: Karel Popper, 1351B Poppy Dr. (Box 637), Willits, Calif. 95490

[21] Appl. No.: 781,286

[22] Filed: Mar. 25, 1977

[51] Int. Cl.[2] ..... C13D 3/14

[52] U.S. Cl. ..... 127/46 A; 127/55; 210/20; 210/27; 210/28; 210/32; 210/38 R

[58] Field of Search ..... 127/46 A, 55; 210/20, 210/27, 30 R, 32, 37 R, 38 R, 28

[56] References Cited

U.S. PATENT DOCUMENTS

| | | | |
|---|---|---|---|
| 3,073,725 | 1/1963 | Popper et al. | 210/30 R |
| 3,293,175 | 12/1966 | Popper et al. | 127/46 A |
| 3,424,674 | 1/1969 | Webber | 210/20 |

FOREIGN PATENT DOCUMENTS

| | | | |
|---|---|---|---|
| 525227 | 5/1956 | Canada | 210/27 |

*Primary Examiner*—Frank A. Spear, Jr.
*Assistant Examiner*—Ivars Cintins

[57] ABSTRACT

Raw sugar beet diffusion juice or raw cane press or diffusion juice is de-ashed by ion exchange using calcium hydroxide, calcium carbonate mangesium hydroxide or calcium sulfite for regenerant. Means are provided whereby slurries can be passed through an ion exchange resin bed without causing said bed to accumulate solids and to clog.

4 Claims, 2 Drawing Figures

TREATMENT OF CRUDE SUGAR JUICES BY ION EXCHANGE

BACKGROUND OF THE INVENTION

Figure 1:
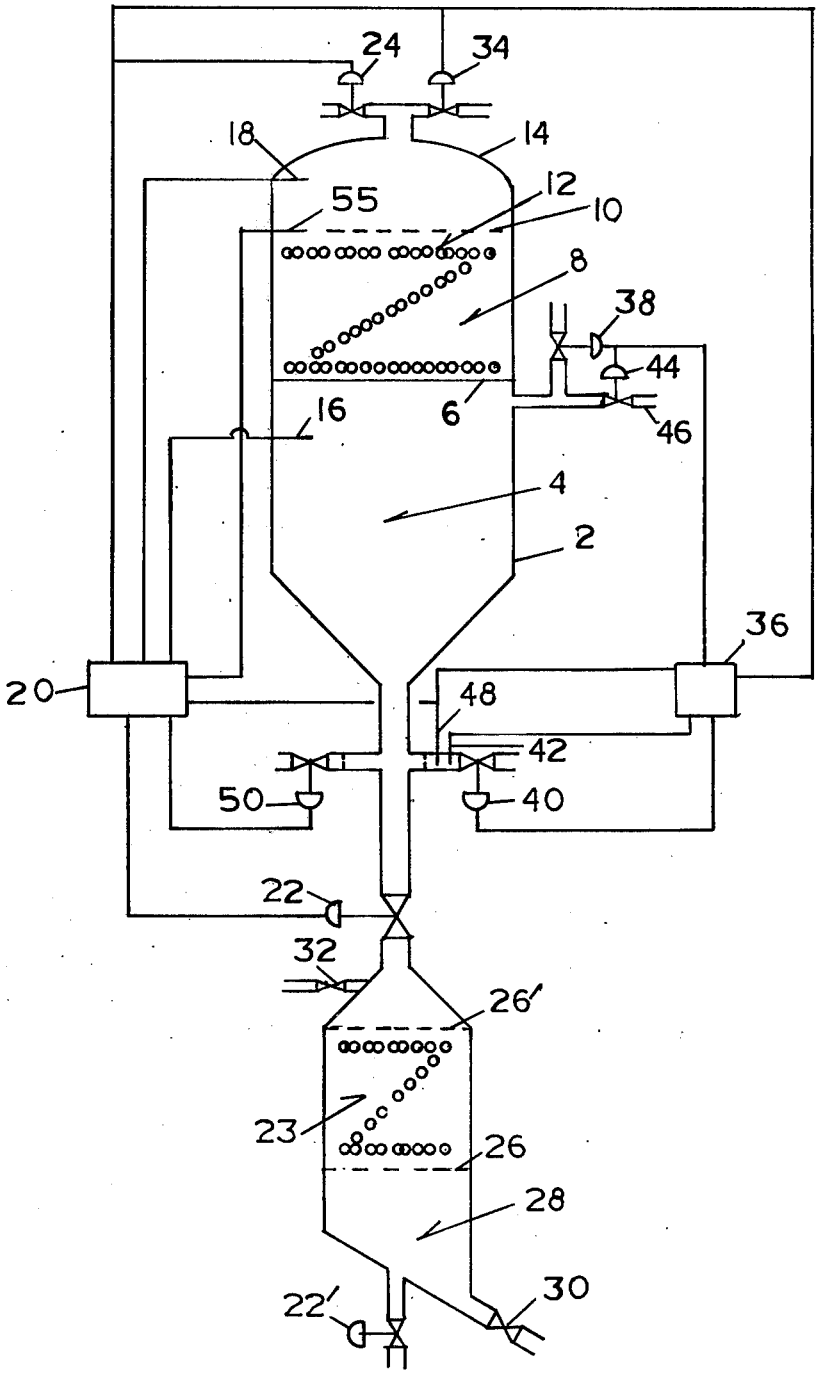

Production of sucrose is essentially a process of fractionate crystallization. This fractionate crystallization is preceded by a number of steps amply documented in literature, e.g. P. Honig: Principles of Sugar Technology. The more impurities are removed, the higher the yield, in the final step, of sucrose. A number of techniques is available to remove such impurities as can not be precipitated and mechanically removed. They may be, for example, electrodialysis, ultrafiltration, reverse osmosis, and, of particular interest to me, ion exchange.

All of the currently proposed techniques result in higher yields of sugar and lower yields of the usually less valuable molasses.

All of these said techniques, however, require substantial pretreatments and have a high capital investment and/or high energy requirement.

This invention does away with many pretreatments and reduces both capital and operating cost.

SUMMARY OF INVENTION

Crude — non-pretreated sugar juice obtained by some extractive or expellent step or by dillution of a concentrate, such as molasses, is freed by means shown later in the application, of gross debris and flown upwards through an ion exchange zone regenerated by inexpensive regenerants by which ion exchange contact and its consequence both polar and non-polar impurities are removed from solution and can be easily separated. Means are shown by which ion exchange resin is confined in the ion exchange zone while fine slurries both during the regeneration step and the impurities removing step are allowed to pass through.

DISCLOSURE OF INVENTION

This invention relates to processing of sugar containing liquids or their precursors such as, for example, but without limitation, sugar beet diffusion juice, cane juice, sweet sorghum juice, date juice, apple juice, pear juice, corn steep liquor, hydrolyzed starch, hydrolyzed cellulose, molasses and any such liquids as contain appreciable amounts of sugars.

A part of the art, i.e. ion exchange of the cations for calcium and of the anions for hydroxyl with subsequent precipitation of the calcium as the nearly insoluble carbonate is taught in Popper and Slamecka U.S. Pat. No. 3,073,725 (Jan. 15, 1963)

The drawback of the art taught in said U.S. Pat. No. 3,073,725 is that the fluid to be processed has to be freed of non-ionic impurities which in many cases contribute a higher impurity load than the ionic non-sugars and that such elimination involves a costly processing step and inevitably results in some loss of sugar. Furthermore suspended material has to, as taught in U.S. Pat. No. 3,073,725, be removed prior to contacting the liquid with the ion exchange zone in order to prevent clogging of said ion exchange zone.

When a slurry of calcium hydroxide as described in the aforesaid U.S. Pat. No. 3,073,725, col. 4, Example 5 is passed upflow through a fluidized bed, i.e. a column containing ion exchange resin with a freeboard space, the resin will classify by bulk density, that is the resin in which the greater equivalent weight of the sorbed ion exceeds the swelling of the resin will eventually end up at the bottom of the column which in many applications such as the reaction $2RK + Ca(OH)_2 \rightarrow R_2Ca + 2KOH$, where R denotes a sulfonated polystyrene resin with some 8% crosslinkage of divinylbenzene, a considerable layer of the RK form of the resin will be found at the lower part of the column.

In a similar fashion when a column, consisting of a mixture of a sulfonated polystyrene cation exchanger and a quatenary ammonia polystyrene anion exchanger, is regenerated upflow with a freeboard space that allows the bed to expand, the anion exchanger will be found at the end of the regeneration in the top part of the column because of its considerably lower bulk density, a well known fact utilized industrially in regeneration of mixed ion exchange resin beds with acid and alkali, where the resin is separated on purpose by causing a fluid to flow through a container holding the two types of resin upflow exactly to effect such a separation for regeneration and rinse purposes and is subsequently mechanically re-mixed. An example of such a mechanical mixing and its advantages is given in my aforesaid U.S. Pat. No. 3,073,725, Col. 6, Example 10, lines 18–27 and lines 33–47 of the same Example.

It is therefore an object of this invention to provide means to allow a degree of freedom of movement of the resin that will permit fine particular matter to pass through a column of an ion exchanger or an ion exchanger mixture and at the same time restrain the freedom of the movement of a degree where no classification, i.e. resin separation, will occur. This could, seemingly, be achieved by placing a screen on the top of the column, such screen being fabricated from woven wire, plastic or such like, finely perforated metal or similar. Such a screen, however, will in short order become blinded by particulate matter lodging in it and thus cease to be functional.

Figure 2:
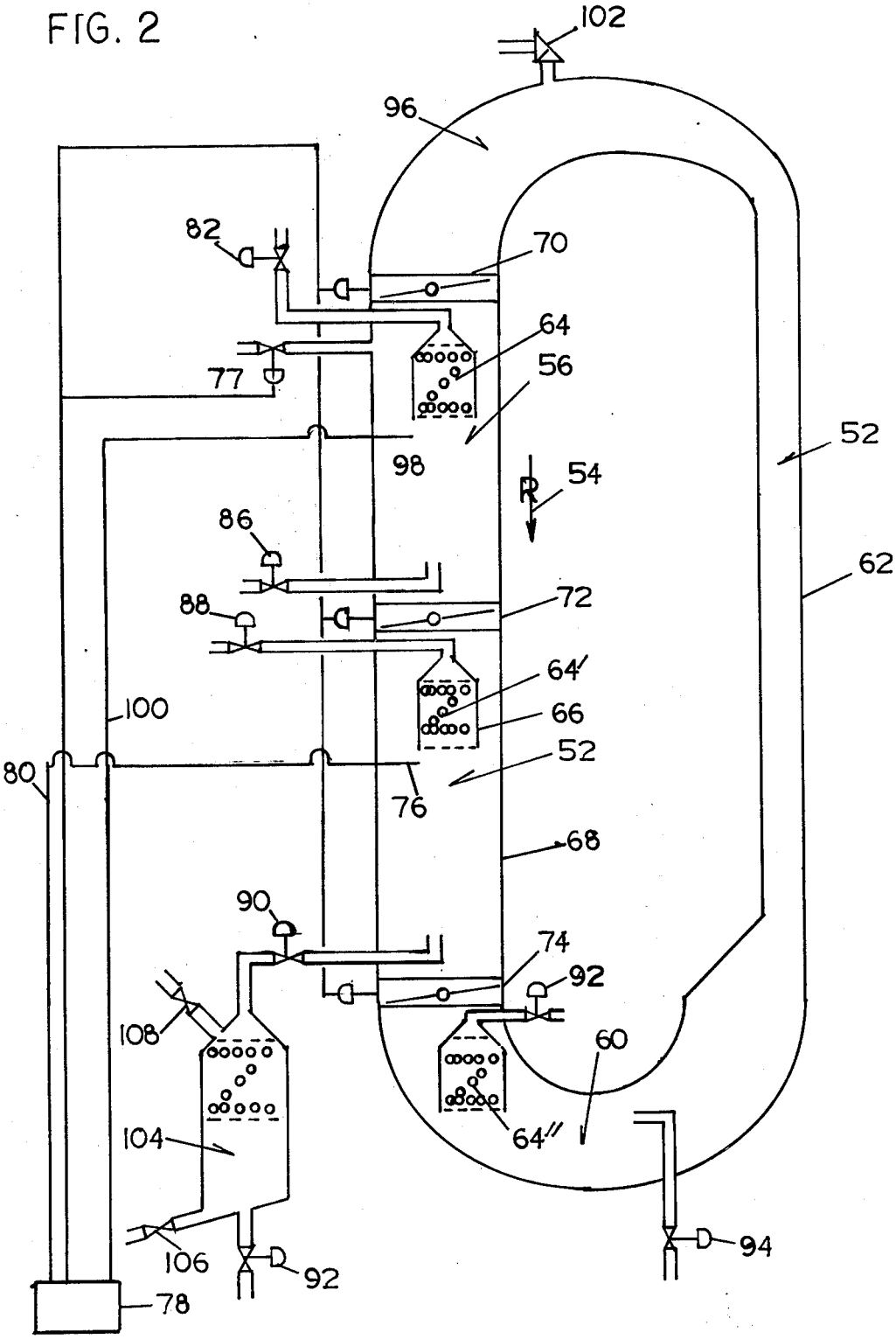

FIGS. 1 and 2 show different embodiments of the invention.

Example 1 illustrated by FIG. 1 shows in a schematic fashion such means as applied to a static column and a way of automation of such a static column. 2 is the shell of the column conveniently constructed of epoxy coated mild steel, fiber glass, polyvinyl chloride or any other material resistant to alkali to pH 12.4 and acid to pH 3.2. The space designated by 4 and limited by an imaginary line 6 contains the ion exchanger resin or mixture of resins.

The space 8 contains material slightly lighter than water and preferably spherical in form. My preferred material are polyethylene beads 1–2 mm in diameter of specific gravity 0.9–0.95, while other material such as cork fragments, light hard wood, beads, any other lighter than water plastic such as, e.g. polyurethane may be used as well. The space 8 is delineated by the imaginary line 6 denoting the upper level of the ion exchanger content and screen 10, said screen being constructed from any corrosion resistant material, the material preferred by me, but not excluding other materials, being polypropylene woven in a square pattern and having openings barely smaller than the e.g. polyethylene beads diameter.

The polyethylene beads are packed very loosely in space 8, so that when that space is filled with liquid no rigid barrier is formed. Space or zone 12 between the top of the beads or other suitable material and the aforesaid screen is deep enough to allow for free bead movement, a suitable depth being 2–8 cm. The screen is fastened in situ by, for example, holding rings or some other suitable means not shown. 14 is the top of the ion exchange column shown in a dome shape, but a conical configuration or even a flat surface may be used.

I shall now, still using FIG. 1 for descriptive reference describe the production steps used in de-ashing of sugar containing fluids. The column has at this point been treated so that the cation exchanger is in the Ca form, i.e. all its available active sites hold calcium, and the anion exchanger is in the OH form.

The potassium ion sensor 16 and the potassium ion sensor 18 detect absence of potassium following regeneration of the resin to be described later in this example. The signaling device 20 e.g. a potentiometer or similar causes solenoid valve 22, 22', and solenoid valve 24 to open and crude sugar containing fluid enter via valve 22' into the pre-screening chamber 23 the upper part of which is constituted by lighter than water beads constrained by screens 26 and 26' of same characterization as the above illustrated screen 10.

Such particles contained in the liquid as may impede proper operation of the ion exchange de-ashing step are rejected by the beads and accumulate in a nether sump zone 28 whence they are removed from time to time by opening the discharge valve 30 and vent valve 32. At this point it is important to stress that valves 22 and 22' must be closed at all times except when the sugar containing fluid flows through them in the upward direction.

The polar load of the sugar containing juice is exchanged for calcium and hydroxyl, thus forming an insoluble precipitate of compounds comprising that group that form insoluble or sparingly soluble calcium salts, such precipitates being of the type usually formed during the common step of beet sugar manufacture, namely liming of diffusion juice which is a costly and exacting process. Many beet sugar factories use up to 3.5% CaO on weight of beets, while other with better beet quality use 2%.

It is a part of this invention that the lime consumption is reduced at least by half since no other ions, these other ions being held on the ion exchanger and out of reaction, impede the calcium and alkalinity precipitation. To indicate the social importance of this feature it should be stated that to convert the starting material, calcium carbonate, to calcium oxide some $10^7$ Btu are used per ton with no existing technology of recapturing that energy.

The sugar containing juice that now consists of water, sugars, insoluble calcium compounds and calcium saccharate flows upward through the ion exchange zone 4 towards lighter than water solid containing material in zone 8, said material rejecting the ion exchange resin and allowing free passage to fine suspension since in the presence of spherical particles some 30% of the volume is void space through which the fine suspension can readily pass. As long as the sensor 16 which I prefer to sense potassium, but which may sense some other contaminant ion such as sodium, sulfate, chloride or some other species that the sugar technologist may consider a proper criterion, senses absence of the contaminant, the solenoid valve 24 remains open and allows exit of the treated juice to a filter not shown to remove by very gentle filtration such as afforded by the art taught in my joint U.S. Pat. No. 3,523,077, Aug. 1970, Camirand and Popper, the calcium precipitate, the clear liquid emanating from such filtration going to carbonation of which only one, rather than the usual two is required. Such carbonation can be carried out by conventional means not shown or may be conveniently carried out by the art taught in my joint U.S. Pat. No. 3,589,516, June 1971, Camirand and Popper.

It is a further part of this invention that carbonation is limited to one step thus greatly simplifying sugar production.

The sensor 16 is placed at a convenient distance from the imaginary line 6 to assure complete exchange of all the polar material for $Ca^{++}$ and $OH^-$, which might not be the case were sensor 18 only to be relied on alone.

When sensor 16 detects an impurity valves 22 and 22' and 24 close, valve 34 remains closed and the signaling device 36 actuated by signaling device 20 causes valves 38 and 40 to open causing air under pressure to enter via valve 38 and to displace the interstitial fluid via valve 40. When water sensor 42, chosen from a variety of water detecting devices, ceases to sense water the signaling device 36 causes valve 38 to close and valve 44 to open while valve 40 remains open and water at a temperature of 40° C to 60° C is admitted via duct 46 and valve 44 and exits to reprocess via valve 40. While the stated water temperatures appear to be the optimal, they must not be construed as limitations and water of any other suitable temperature may be used. It is preferable to use in this step demineralized water, distilled water or ammonia free condensed water from evaporators since this step effects ion exclusion ellution, essentially as taught by Wheaton and Bauman on one hand and by Stark on the other. However, washing the resin free of adhering sugar by water, a step anyone skilled in the art would do automatically, effects said ion exclusion automatically and no infringement on any rights of the above inventors thus takes place, especially in view of the fact that no special technique taught by them is employed.

When the sugar concentration in this wash water as sensed by sensor 48 which may conveniently be a refractometer, but may also be any other suitable device, drops below practical level, the signaling device 36 causes valves 40 and 44 to close and the signaling device 20 activated by sensor 48 causes valves 34 and 50 to open thus allowing the regenerant slurry to flow upwards through the apparatus, impelled by means, such as a pump, not shown.

It is a further object of this invention that the entire regenerant stream is directly usable as fertilizer without any additional treatment as it contains nutrients originally removed by the beet from the soil and in addition contains calcium which is widely used as soil conditioner.

When sensor 18 indicates absence of the contaminant chosen as criterion of completed regeneration, the signaling device 20 causes valves 22, 22' and 24 to open and the purification process described above is repeated. It may be found convenient to interpose a sugar sensing device 55 so that the signaling device 20 will cause valve 34 to be open and valve 24 closed until detection of sugar to avoid undue entrance of water into the system and cause valve 34 to close and valve 24 to open upon detection of sugar.

Evidently ion exchange reactions proceed best in a continuous counter-current system, and it is this writer's opinion that it took the genius of I. R. Higgins to develop a tool in which such an operation could be carried out The Higgins loop, however, same as most other ion exchange apparatus presupposes the use of precipitate free fluids.

It is a further object of this invention to introduce into the continuous countercurrent system means that allow ion exchange treatment of suspensions.

It is also an object of this invention to regenerate ion exchange resin with the group of very insoluble compounds, comprising among others the very insoluble compounds of alkaline earth metals, such as, for example calcium carbonate, magnesium hydroxide, calcium sulfite and similar.

It is a further object of this invention to use, typically, calcium carbonate as a regenerant especially in the treatment of such sugar bearing juices as contain reducing sugars, i.e. glucose and fructose, that are subject to alkaline hydrolysis and where therefore exchange for the basic calcium hydroxide is counterindicated. Regeneration with calcium carbonate is entirely possible; so, for example I found it possible to mix a sulfonated polystyrene cation exchanger and an alkylalkanol ammonia polystyrene anion exchanger, known in the trade as duolite C-20 and Duolite A 102-D the cation exchanger having been fully converted to the sodium form by passage through a column containing it of a solution of sodium hydroxide and the anion exchanger to the chloride form by passing through a column containing it a solution of hydrochloric acid, rinsing the two exchangers to absence of alkali and acid respectively, mixing the said regenerated and washed exchangers in a beaker containing a solution of 3,500 ppm of sodium chloride, stirring the said ion exchanger in the said solution and gradually adding to the system dry calcium carbonate. Analysis of both the liquid and of the exchanger confirmed conversion of the cation exchanger to the calcium and the anion exchanger to the carbonate form.

Example 2, illustrated by FIG. 2, shows how the means of retaining resin in the system and allowing the fine slurries to pass is achieved. 52 denotes in a schematic fashion what is essentially the well known Higgins' loop. The direction of resin movement is indicated by 54 where R stands for resin and the arrow indicates the resin or vessel charge movement direction. 56 is the regeneration section, that is that portion of the apparatus where the resin is converted into the desired chemical form.

68 is the stripping section, that is, that portion of the apparatus where the desired removal of impurities as set forth in Example 1 takes place. 60 is the residual liquid and ion exclusion sugar recovery section of the apparatus. 62 is merely a resin conduct tube with no other function but transport. The function of the apparatus shown in FIG. 2 is merely to operate continuously which entails some savings as opposed to the schematic of FIG. 1, nevertheless, except for better efficiency of regeneration with extremely sparingly compounds it offers no further chemical advantage. The advantages inherent in the Higgins' loop are amply taught by Higgins and no claim to them is made in this application. 64, 64' and 64" are the means of rejection of resin and permissivity of passage of fine slurries and will be discussed in some detail now. The chosen media included in these chambers 64, 64' and 64" are lighter than water. They may be, as said in Example 1, many things, however, and without limitation, for simplicity sakes, I am referring to them in this embodiment as spherical or nearly spherical polyethylene beads of a specific gravity smaller than 1.

This means that during the operation, where all flows are upward the void spaces between the beads are large enough to allow passage of very small particles and yet are small enough to prohibit the passage of the ion exchange resin.

It is an object of this invention to size the chambers in such a fashion (and not shown in the merely schematic drawing in FIG. 2) that the area of the annulus constituted by the difference of the area of the rejection chamber and that of the reaction vessel is equal to or greater than the respective areas of open valves 70, 72 and 74. This means that said chambers 64, 64' and 64" do not impede the flow of the resin during the resin movement to be described hereafter.

The operation of the system is governed by two sensors emitting signals to one (or more) signaling and activating assemblies 78. 76 is a specific ion electrode sensing the presence, level or absence of such an ion as the sugar technologist may deem to be the proper criterion. The preferble ion to be sensed is potassium, however, and without limitation detection of ions such as $Na^+$, $So_4^=$, $Cl-$ or other may be used.

When the sensor 76 senses the presence of an impurity chosen from the group of the aforesaid contaminants, it transmits a signal via conduct 80 to the said signaling and activating device 78 which causes valves 82, 86, 88, 90, 92 and 94 to close, thus temporarily stopping the entire operation and simultaneously cause valves 72, 74 and 77 to open. Valve 77 admits air under pressure to enter the system and forces the resin charge to the general area 96. When sensor 98 senses absence of liquid and transmits a signal to that effect via conductor 100 to the signals and activating device 78, said device causes valves 72 and 74 to close, valve 70 to open and allow the resin charge from space 96 to drop to space 56 whereupon valve 70 is caused to close be it by a signaling device not shown or by change in pressure sensed by the pressure relieve valve 102 otherwise used to facilitate the resin movement. The aforesaid solenoid operated valves 82, 86, 88, 90, 92 and 94 have the following operational functions:

86 admits the regenerant slurry, 82 allows the desorbed impurities, precipitated impurities and excess regenerant to exit, 90 allows the crude juice admitted via valve 92 and screening chamber 104 enter the purification chamber 68 and valve 88 allows the treated juice to exit to further processing as described above in Example 1. Valve 92 permits during one stage compressed air to enter to displace liquid from chamber 60 via valve 94 and in the second stage allows water entering via valve 94 to exit, said water containing sugar leached from the resin by ion exclusion, essentially as described in the pertinent language of Example 1. Valve 106 is opened whenever discharge of particulate matter is required and valve 108 facilitates that discharge by serving as a vent since obviously valves 80 and 92 are closed during that discharge operation. All flows are caused by pumps or other obvious means not shown.

Having thus described my invention, I claim:

1. In a process for treating a crude sugar juice slurry containing potassium ions and large particulate matter in which the crude sugar juice slurry is first filtered to remove said large particulate matter and then treated by passing the filtered slurry through an ion-exchange zone comprising a mixed bed of cationic and anionic ion exchange resins charged with calcium and hydroxyl ions to exchange said potassium ions for calcium ions and thereby forming calcium precipitates within the treated sugar juice slurry, the improvement in constraining the ion exchange resins within said ion exchange zone while allowing the calcium precipitates to pass therethrough without plugging comprising maintaining a fluidized bed of constraining beads having a density less than water above and in direct communication with said ion-exchange resins, and wherein the size of said constraining beads being selected so as to permit passage of said calcium precipitates while rejecting passage and said ion-exchange resins.

2. The process defined in claim 1 wherein said mixed bed of ion exchange resins are regenerated with calcium sulfite.

3. The process defined in claim 1 wherein said mixed bed of ion exchange resins are regenerated with magnesium hyroxide.

4. The process defined in claim 1 wherein calcium carbonate is the regenerant for the mixed bed of ion exchange resins.

* * * * *